US008375713B2

(12) United States Patent
Ryan et al.

(10) Patent No.: US 8,375,713 B2
(45) Date of Patent: Feb. 19, 2013

(54) EGR COOLER CLEANING SYSTEM AND METHOD

(75) Inventors: Steve Ryan, Villa Park, IL (US); Luis Carlos Cattani, Aurora, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 567 days.

(21) Appl. No.: 12/631,068

(22) Filed: Dec. 4, 2009

(65) Prior Publication Data

US 2011/0131979 A1 Jun. 9, 2011

(51) Int. Cl.
*F02B 33/44* (2006.01)

(52) U.S. Cl. ..... 60/605.2; 123/568.12

(58) Field of Classification Search ..... 60/605.2, 60/611; 123/568.12
See application file for complete search history.

(56) References Cited

U.S. PATENT DOCUMENTS 5,426,936 A * 6/1995 Levendis et al. ..... 60/278
5,520,366 A 5/1996 Elliott
5,669,365 A * 9/1997 Gartner et al. ..... 123/568.12
7,357,829 B2 4/2008 Ehlers
2002/0157539 A1* 10/2002 Rosenberg ..... 95/280
2007/0084206 A1* 4/2007 Lew et al. ..... 60/599
2007/0144503 A1* 6/2007 Lohmann ..... 123/568.15
2007/0157809 A1* 7/2007 Ehlers ..... 95/280
2009/0120089 A1* 5/2009 Chillar et al. ..... 60/605.2

* cited by examiner

*Primary Examiner* — Thomas Denion
*Assistant Examiner* — Patrick Maines
(74) *Attorney, Agent, or Firm* — Mark C. Bach; Jeffrey P. Calfa

(57) ABSTRACT

A method for dislodging exhaust gas deposits from an exhaust gas recirculation (EGR) cooler (26) associated with an engine includes the steps of providing at least one on-board gas source (S) for providing a gas (G) at a superatmospheric pressure, and placing the EGR cooler in fluid communication with the gas source through a supply conduit (44, 144). The supply conduit (44, 144) includes at least one valve (V) that is selectively operable to a closed condition closing the supply conduit and to an open position opening the supply conduit. The method also includes the step of operating the at least one valve (V) from the closed condition to the open condition to allow the superatmospheric gas (G) to flow through the supply conduit (44, 144) to the EGR cooler (26).

1 Claim, 2 Drawing Sheets

G
1
2
3
...
N
Time

40
S1
S2
S3
SN
42
V1
V2
V3
VN
44
G
46
EGR
EGR COOLER
26
48
50
EG
38
28 Intake Manifold
34
22 CAC
32
C
20
16
T
18
30
EG
14
12 Exhaust Manifold
EG
36
24
10

EGR COOLER CLEANING SYSTEM AND METHOD

BACKGROUND

Embodiments described herein relate to a system and method for cleaning an exhaust gas recirculation (EGR) component. More specifically, embodiments described herein relate to a system and method for removing deposits in an EGR cooler.

Exhaust gas recirculation (EGR) is used to reduce nitrogen oxide (NOx) emissions in both gasoline and diesel engines. NOx is primarily formed when a mix of nitrogen and oxygen is subjected to high temperatures. EGR systems recirculate a portion of an engine's exhaust gas back to the engine cylinders. Intermixing fresh, incoming air with recirculated exhaust gas dilutes the mix, which lowers the flame temperature and reduces the amount of excess oxygen. The exhaust gas also increases the specific heat capacity of the mix, which lowers the peak combustion temperature. Since NOx is more readily formed at high temperatures, the EGR system limits the generation of NOx by keeping the temperatures low.

Many EGR systems include at least one EGR cooler connected in series or in parallel between an exhaust manifold and an intake manifold of an engine. Some engines, especially compression ignition or diesel engines, use the EGR coolers to cool the portion of exhaust gas being recirculated. The cooled exhaust gas has a lower latent heat content and can aid in lowering combustion temperatures even further. In general, engines using EGR to lower their NOx emissions can attain lower emissions by cooling the recirculated exhaust gas as much as possible.

Exhaust gas constituents in the exhaust gas being recirculated to the intake manifold may build-up on the EGR cooler. Further, various hydrocarbons may condense onto the EGR cooler. The build-up of deposits and condensation may cause a degradation of heat transfer efficiency and an increase in the pressure drop across the EGR cooler, which may eventually result in the overall loss of engine performance and efficiency.

The most common ways that deposit build-up are addressed include removing and cleaning the EGR cooler, and replacing the EGR cooler. Additionally, condensation of exhaust gas constituents has been addressed by delaying initiation of EGR under cold start conditions, limiting the amount of exhaust gas being recirculated, or limiting the amount of cooling applied to the recirculated exhaust gas in an effort to minimize the degree and amount of condensates. These measures, although effective in increasing the service life of engine components and decreasing the likelihood of failures, may be insufficient in addressing the impact that the EGR system has on the emissions generated by the engine.

SUMMARY

A method for dislodging exhaust gas deposits from an exhaust gas recirculation (EGR) cooler associated with an engine includes the steps of providing at least one on-board gas source for providing a gas at a superatmospheric pressure, and placing the EGR cooler in fluid communication with the gas source with a supply conduit. The supply conduit includes a valve that is selectively operable to a closed condition closing the supply conduit and to an open position opening the supply conduit. The method also includes the step of operating the valve from the closed condition to the open condition to allow the superatmospheric gas to flow through the supply conduit to the EGR cooler.

Another method for dislodging exhaust gas deposits from an exhaust gas recirculation (EGR) cooler associated with an engine includes the steps of providing gas sources that are each capable of providing a gas having superatmospheric pressure. Each of the gas sources has a corresponding valve disposed in a parallel arrangement. The method also includes the step of placing the EGR cooler in fluid communication with the superatmospheric gas through a supply conduit. The valves are selectively operable to a closed condition closing the supply conduit and to an open position opening the supply conduit from the corresponding gas source. The method further includes the step of delivering the superatmospheric gas to the EGR cooler through a nozzle disposed at the end of the supply conduit.

An EGR cooler cleaning system for dislodging exhaust gas deposits from an exhaust gas recirculation (EGR) cooler associated with an engine a gas source configured to fluidly communicate a superatmospheric gas to the EGR cooler. The cooler cleaning system also has a gas pulse delivery system having a valve that is selectively operable to a closed condition closing the supply conduit, and to an open position opening the supply conduit. The opening and closing of the valve creates percussive pulses of the superatmospheric gas. A supply conduit is configured for delivering the percussive pulses of superatmospheric gas to at least one nozzle.

DETAILED DESCRIPTION

Figures 1, 2:
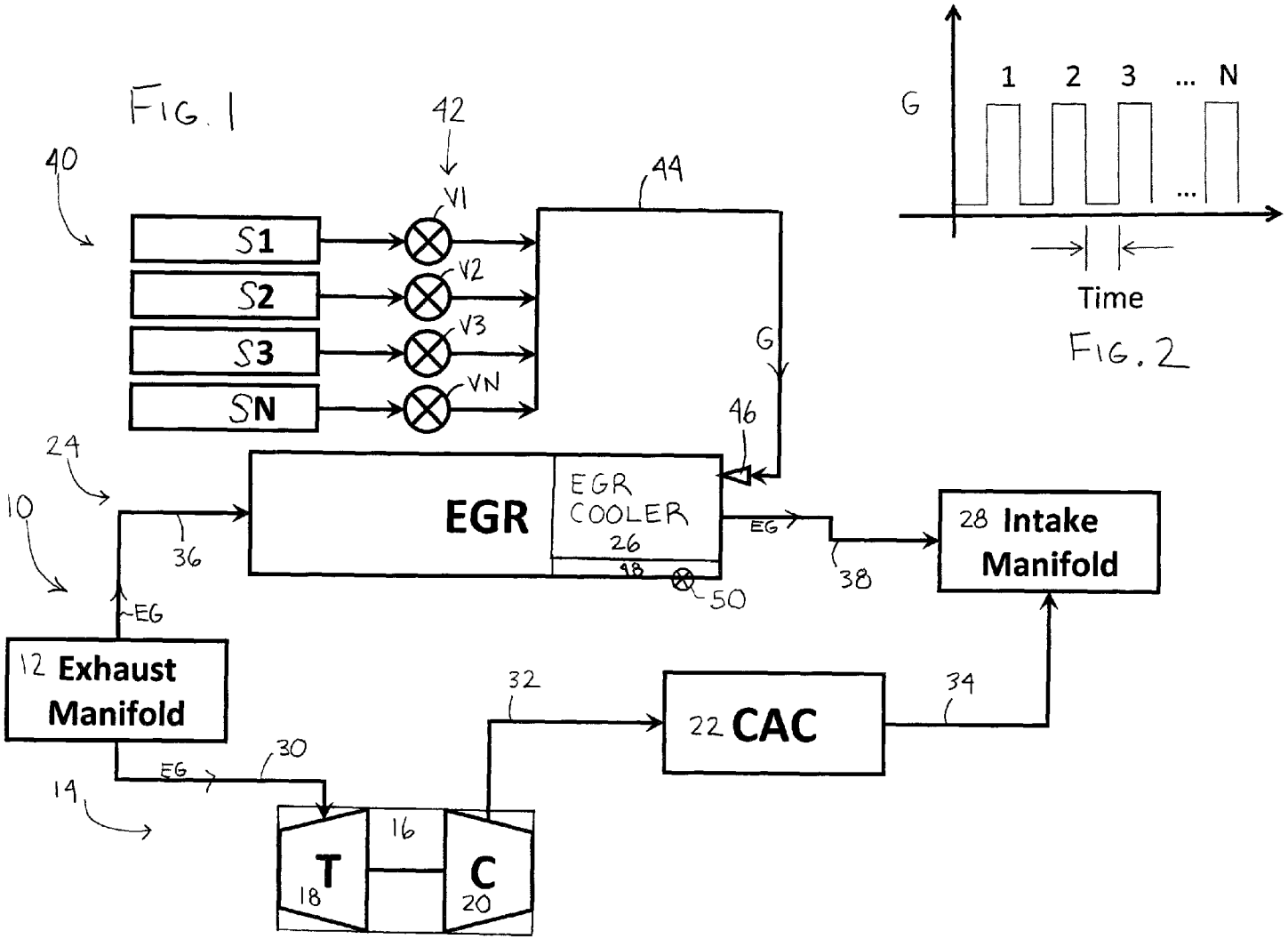
FIG. 1 is a schematic of an exhaust gas system having an EGR cooler cleaning system in fluid communication with an EGR cooler.
FIG. 2 is a schematic indicating the pulsing of superatmospheric gas to the EGR cooler.
Figure 3:
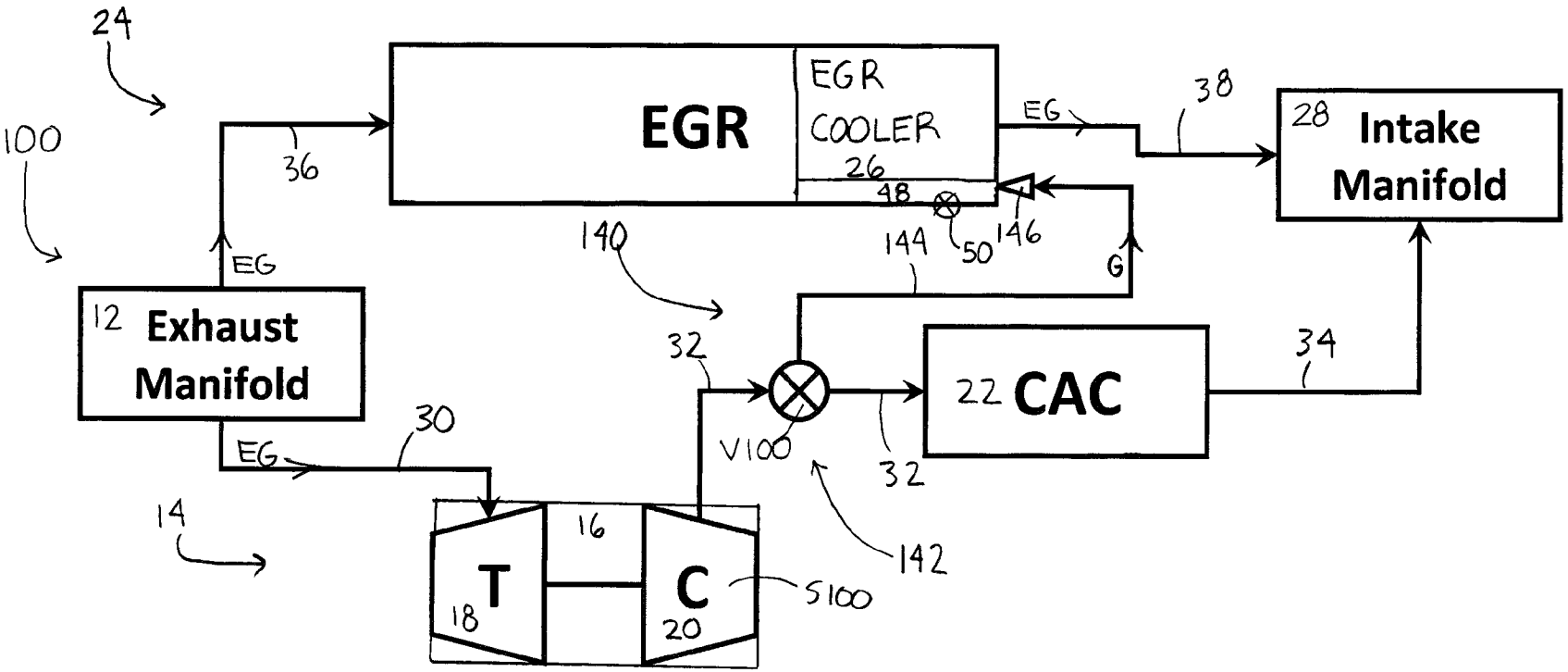
FIG. 3 is a schematic of the exhaust gas system having an alternative EGR cooler cleaning system in fluid communication with the EGR cooler.

Referring to FIGS. 1 and 3, a schematic diagram of an exhaust system, generally shown at 10, includes an engine exhaust manifold 12 that routes exhaust gas EG to a turbocharger system 14. The turbocharger system 14 includes a turbocharger 16 having a turbine 18 and a turbo compressor 20. The turbocharger system 14 receives a first portion of the exhaust gas EG from the engine exhaust manifold 12. Downstream of the turbocharger 16 is a charge air cooler (CAC) 22.

The exhaust manifold 12 also routes exhaust gas EG to an exhaust gas recirculation (EGR) system 24 that includes an EGR cooler 26. The EGR system 24 may include other components, such as a diesel oxidation catalyst, a diesel particulate filter, valves, sensors, filters, among other components. The EGR system 24 receives a second portion of the exhaust gas EG from the engine 10. The EGR cooler 26 routes exhaust gas EG to an engine intake manifold 28.

Each of the cylinders of an engine (not shown) are connected to the exhaust system 10 through the engine exhaust manifold 12. The engine exhaust manifold 12 is in fluid communication with the turbine 18 of the turbocharger 16 with a first exhaust passage 30. The exhaust gas EG turns the turbine 18, which causes the turbo compressor 20 to pressurize a charge of air. The charge of air flows through a second air passage 32 to the CAC 22 where it is cooled. From the CAC 22, the cooled charge of air flows to a second turbostage or to the engine intake manifold 28 on a third air passage 34.

A fourth exhaust passage 36 is located on the EGR system 24 and permits the fluid communication of the exhaust manifold 12 with the EGR cooler 26. From the EGR cooler 26, the cooled exhaust gas flows to the engine intake manifold 28 on a fifth exhaust passage 38. The engine intake manifold 28 is fluidly connected to the cylinders to provide the engine with a mixture of cooled exhaust gas EG from the EGR system 24 and charge air from the turbocharger system 14. While in the engine cylinders, the mixture (exhaust gas and fresh air) is additionally mixed with fuel, yielding useful work to the engine, heat and exhaust gas EG.

Exhaust gas deposits build-up on the EGR cooler 26, which may cause a degradation of heat transfer efficiency and an increase in the pressure drop across the EGR cooler. The build-up of exhaust gas deposits may eventually result in the overall loss of engine performance and efficiency.

Referring now to FIGS. 1 and 2, an EGR cooler cleaning system 40 supplies superatmospheric gas G to the EGR cooler 26. The superatmospheric gas G may be delivered to the EGR cooler 26 in percussive pulses, in varying amounts of pressure over time, or in a constant amount of pressure over time. At least one on-board gas source S1, such as a tank, is in fluid communication with the EGR cooler 26. The at least one gas source S1 is charged with a gas, such as air, to a superatmospheric pressure. A gas pulse delivery system 42 includes at least one control valve V1 that is selectively operable for fluidly communicating percussive pulses of superatmospheric gas that are capable of dislodging deposits on the EGR cooler 26.

The air pulse delivery system 42 includes at least one supply conduit 44 for delivering the superatmospheric gas G to at least one nozzle 46 disposed at the end of the supply conduit. The nozzle 46 delivers the percussive pulses of superatmospheric gas G to the EGR cooler 26. The at least one control valve V1-VN is selectively operable from a closed condition closing the supply conduit 44 that forms the flow path of the superatmospheric gas G and to an open condition opening the supply conduit for the flow of the superatmospheric gas G from the at least one gas source S1-SN to the nozzle 46. At the downstream or outlet side of the EGR cooler 26, the at least one nozzle 46 may be placed directly against the EGR cooler or may be spaced a distance from the EGR cooler. It is also possible that the nozzle 46 can be placed at locations other than the outlet side of the EGR cooler 26.

The EGR cooler cleaning system 40 of FIG. 1 has multiple gas sources, S1, S2, S3 . . . SN with multiple control valves V1, V2, V3 . . . VN. Each of the plurality of gas sources S1-SN has a corresponding valve V1-VN from the plurality of valves disposed in a parallel arrangement. It is also possible that gas sources S1-SN may be fluidly connected to control valves V1-VN in a series arrangement, or some combination of parallel and series arrangement.

As seen in FIG. 2, the control valves V1-VN may open asynchronously and with a time delay to provide multiple pulses of superatmospheric gas G. It is also possible that the control valves V1-VN may open asynchronously without a time delay between pulses. The control valves V1-VN may also open synchronously in multiple or single pulses, or in any other arrangement.

The gas sources S1-SN store charges of gas in a suitable volume and at a suitable pressure to enable suitable percussive pulses to be delivered to the EGR cooler 26 to dislodge and free deposits from the EGR cooler. The gas sources S1-SN may be capable of holding gas at a pressure in excess of 125 psi, however lower pressures are possible. Any suitable gas source can be used to charge the onboard gas sources S1-SN. Any air compressor device, such as the air compressor devices on commercial vehicles, could be used as an on-board source to charge the tanks S1-SN. Alternatively, shop air is a gas that is readily available at sufficiently high pressure at automotive and trucking service facilities, and can be delivered and stored in the gas sources S1-SN.

Valves capable of delivering percussive pulses are described in U.S. Pat. No. 5,520,366 "Rapid Pulse Delivery Diaphragm Valve", which is incorporated by reference herein. This valve includes a solenoid that is actuated by electricity to open the valve. The valve has a diaphragm that is held seated on a valve seat closing when the solenoid is not actuated. When the solenoid is actuated, the hold on the seat is released. Rapid opening of the valve is accomplished by using the pressure of air present at the valve inlet to lift the diaphragm off the seat. Any other valve or other devices that deliver a pulse of superatmospheric gas G from at least one gas source S1 to the EGR cooler 26 are also possible.

The combination of force of superatmospheric gas G with the percussive pulses of superatmospheric gas dislodges and frees deposits from the surface and pathways of the EGR cooler 26. The cleaning system 40 may be actively operated to deliver superatmospheric gas G during engine use, during start-up conditions, or after shutdown. Normal exhaust gas EG flow is then able to sweep away the dislodged deposits.

Referring now to FIG. 3, an alternate embodiment of an EGR cleaning system is indicated generally at 140, the cleaning system being used on the exhaust gas system 100. The EGR cleaning system 140 includes the turbo compressor 20 as the superatmospheric gas source S100, which is in fluid communication with the EGR cooler 26. The superatmospheric gas G is charge air that is diverted by at least one control valve V100 on the second passage 32. The gas source S1 provides charge air in a suitable volume and at a suitable pressure to dislodge and free deposits from the EGR cooler.

The superatmospheric gas G may be delivered to the EGR cooler 26 in percussive pulses, in varying amounts of pressure over time, or in a constant amount of pressure over time. A gas pulse delivery system 142 includes the at least one control valve V100 for creating percussive pulses of superatmospheric gas that are capable of dislodging deposits on the EGR cooler 26.

The air pulse delivery system 142 also includes at least one supply conduit 144 for delivering the superatmospheric gas G to at least one nozzle 146. The at least one nozzle 146 delivers the percussive pulses of superatmospheric gas G to the EGR cooler 26. Similar to the nozzle 46, the nozzle 146 may be placed directly against the EGR cooler 26 or may be spaced a distance from the EGR cooler.

The EGR cooler cleaning system 140 of FIG. 3 may also have multiple gas sources S1 with multiple control valves V1, such as multiple turbo compressors 20 or the addition of tanks. In a multiple gas source S1-SN embodiment, the gas sources may open synchronously or asynchronously. In both the single gas source or the multiple gas source S1-SN embodiments, the pulses of superatmospheric gas G may be delivered to the nozzle 146 with a time delay or without a time delay, to provide a single or multiple pulses of superatmospheric gas G to the EGR cooler 26.

It is possible that a collection device 48 could be used in conjunction with the EGR cooler cleaning system 40, 140 to collect large particles. The collection device 48 may include a cavity having a valve 50 to dispense the collected particles or may have a burner to incinerate the collected particles. It is also possible that the EGR cooler cleaning system 40, 140 can be incorporated on any exhaust gas system 10, 100 having an EGR cooler 26 and a source of compressed gas on the vehicle, such as an air compressor, a turbocharger, a supercharger, among other sources of compressed gas.

What is claimed is:

1. An on-board EGR cooler cleaning system for dislodging exhaust gas deposits from an exhaust gas recirculation (EGR) cooler associated with an engine of a vehicle wherein the EGR cooler cools exhaust gas before discharging to an intake conduit in fluid communication with the intake manifold of the engine, the cleaning system comprising:

a plurality of on-board gas sources configured to fluidly communicate a superatmospheric gas to the EGR cooler, wherein the superatmospheric gas is a gas other than exhaust gas;

a plurality of valves, each of the plurality of valves corresponding to the plurality of gas sources, the plurality of valves having a parallel arrangement and being selectively operable to open and close to communicate percussive pulses of superatmospheric gas from the plurality of on-board gas sources;

a supply conduit in fluid communication with each of the plurality of valves;

a nozzle disposed at the terminal end of the supply conduit, wherein the nozzle fluidly communicates the pulses of superatmospheric gas from the plurality of valves to an outlet of the EGR cooler during one of use of the engine, during start-up of the engine, and after shutdown of the engine; and a collection device disposed on the EGR cooler having a valve to dispense the collected deposits.

* * * * *